US007396299B2

(12) United States Patent
Nicolette et al.

(10) Patent No.: US 7,396,299 B2
(45) Date of Patent: Jul. 8, 2008

(54) WEIGHT ADJUSTMENT MEMBER FOR GOLF CLUB HEAD

(75) Inventors: Michael R. Nicolette, Scottsdale, AZ (US); John A. Solheim, Phoenix, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 313 days.

(21) Appl. No.: 11/210,029

(22) Filed: Aug. 22, 2005

(65) Prior Publication Data

US 2007/0042834 A1 Feb. 22, 2007

(51) Int. Cl.
*A63B 53/04* (2006.01)
*A63B 53/06* (2006.01)

(52) U.S. Cl. ..... 473/350; 473/334

(58) Field of Classification Search ..... None
See application file for complete search history.

(56) References Cited

U.S. PATENT DOCUMENTS 2,056,335 A * 10/1936 Wettlaufer ..... 473/245
4,326,326 A 4/1982 MacDonald
4,754,977 A 7/1988 Sahm
4,852,880 A * 8/1989 Kobayashi ..... 473/349
5,439,223 A * 8/1995 Kobayashi ..... 473/334
5,749,794 A * 5/1998 Kobayashi et al. ..... 473/342
6,206,790 B1 3/2001 Kubica
6,913,545 B2 7/2005 Jones

FOREIGN PATENT DOCUMENTS

JP 2001161868 A * 6/2001
JP 2003047678 A * 2/2003

* cited by examiner

*Primary Examiner*—Alvin A Hunter
(74) *Attorney, Agent, or Firm*—Darrell F. Marquette

(57) ABSTRACT

A weight adjustment member may be mounted in a tuning port in a golf club head and secured therein using adhesive. The weight adjustment member includes a lip which prevents excess adhesive from escaping the tuning port and hides adhesive that might otherwise be visible between the weight adjustment member and the tuning port. Locating devices that mate with each other are included in the tuning port and on the weight adjustment member. A method of mounting the weight adjustment member in the tuning port of a golf club head is also provided.

20 Claims, 3 Drawing Sheets

WEIGHT ADJUSTMENT MEMBER FOR GOLF CLUB HEAD

BACKGROUND OF THE INVENTION

The present invention relates generally to golf equipment and, in particular, to a weight adjustment member for a golf club head.

U.S. Pat. No. 6,206,790 to D. J. Kubica et al discloses an iron-type golf club head having a primary cavity formed in its back face by a perimeter weighting element which protrudes rearwardly from its front face. A secondary cavity or tuning port defined within the primary cavity contains a weight adjustment member. In the Kubica patent, the weight adjustment member comprises a top surface, a bottom surface, and a side surface extending between said top and bottom surfaces with a groove formed in the side surface extending peripherally of the weight adjustment member. According to the Kubica patent, if epoxy is applied to the bottom of the weight adjustment member in order to affix the weight adjustment member in the tuning port, any excess epoxy collects in the groove and is prevented from being pushed out of the secondary cavity.

U.S. Pat. No. 6,913,545 to D. D. Jones et al discloses a face insert mounted in a cavity in the front face of a golf club head. The face insert is formed with a continuous protrusion extending outwardly from its perimeter edge. The protrusion is sized and shaped to form a close tolerance fit within the cavity in order to properly position the face insert with respect to the cavity.

Although a weight adjustment member with a groove formed in its side surface, such as the weight adjustment member described in the Kubica patent, is effective for preventing most of the excess adhesive used to affix the weight adjustment member in a tuning port of an iron-type golf club head from being pushed out of the tuning port, excess adhesive will, nevertheless, occasionally be pushed out of the tuning port, marring the back face of the golf club head. Additionally, the adhesive, while not escaping the tuning port, may be visible between the weight adjustment member and the tuning port wall, resulting in a less than desirable appearance. Thus, there is a need for a weight adjustment member that more effectively prevents excess adhesive from escaping the tuning port, hides any excess adhesive that escapes the tuning port, and hides adhesive between the weight adjustment member and the tuning port wall.

SUMMARY OF THE INVENTION

The present invention provides a weight adjustment member or an insert for a golf club head wherein the golf club head includes a tuning port with a rim. The weight adjustment member or insert comprises a base adapted to be received in the tuning port, and a cap connected to the base. The cap has a lip projecting outwardly for concealing at least a portion of the tuning port rim when the base is received in the tuning port. A first locating device on a bottom surface of the base mates with a second locating device on a bottom wall of the tuning port. In one embodiment of the weight adjustment member, the first locating device comprises an indentation and the second locating device comprises a protrusion.

DESCRIPTION OF THE INVENTION

Figure 1:
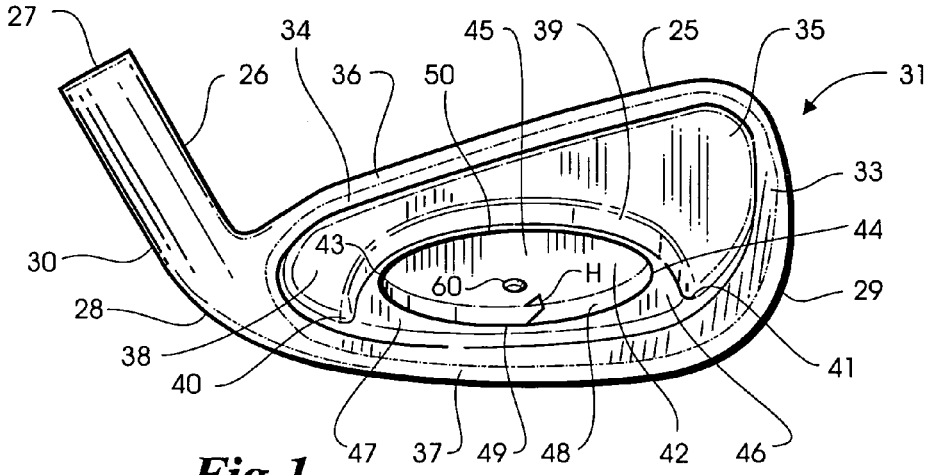
FIG. 1 is a rear elevational view an iron-type golf club head into which the weight adjustment member shown in FIGS. 7-10 may be mounted.
Figure 2:
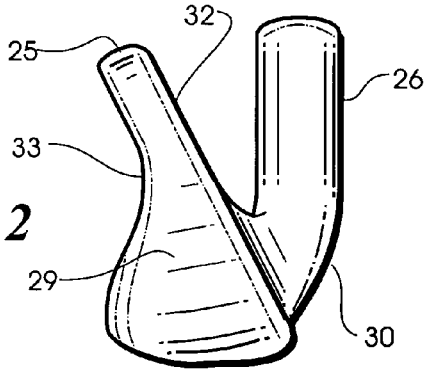
FIG. 2 is toe end view of the golf club head of FIG. 1.
Figure 3:
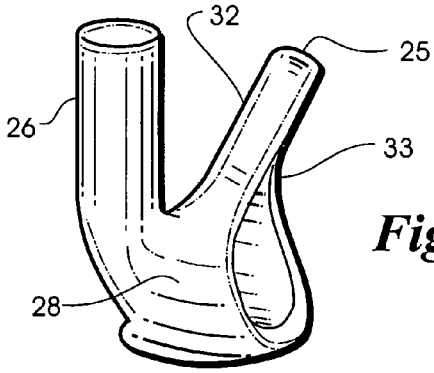
FIG. 3 is a heel end view of the golf club head of FIG. 1.
Figure 4:
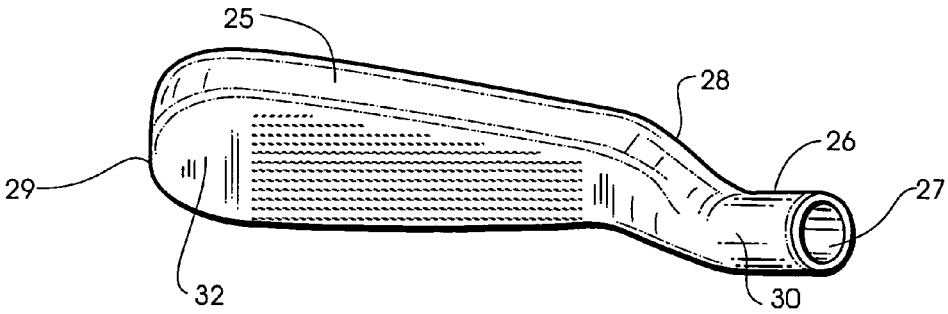
FIG. 4 is a top view of the golf club head of FIG. 1.
Figure 5:
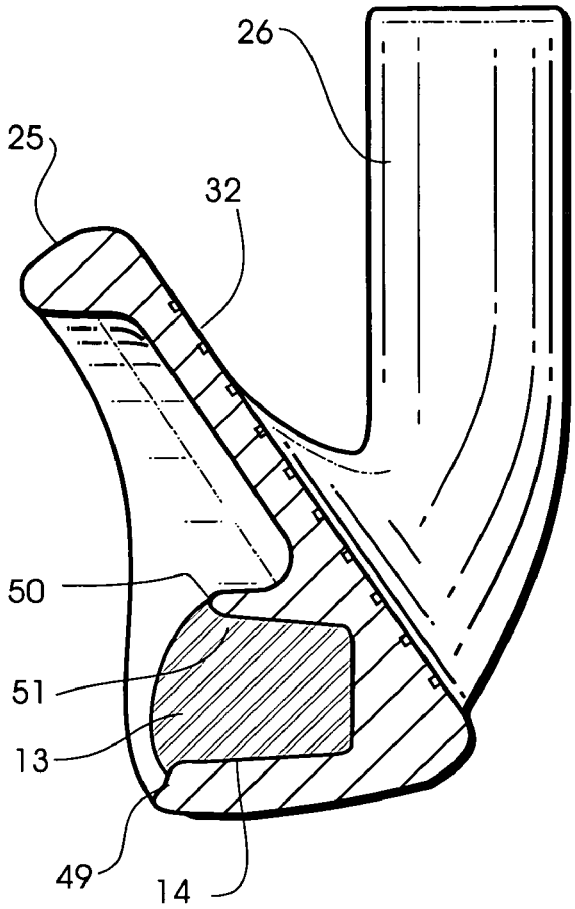
FIG. 5 is a sectional view of another iron-type golf club head with the weight adjustment member shown in FIG. 6 mounted therein.
Figure 6:
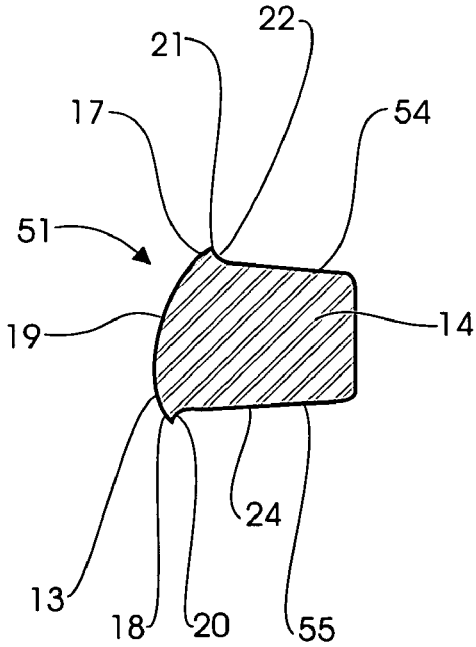
FIG. 6 is a side view of a weight adjustment member according to one embodiment of the present invention.
Figure 7:
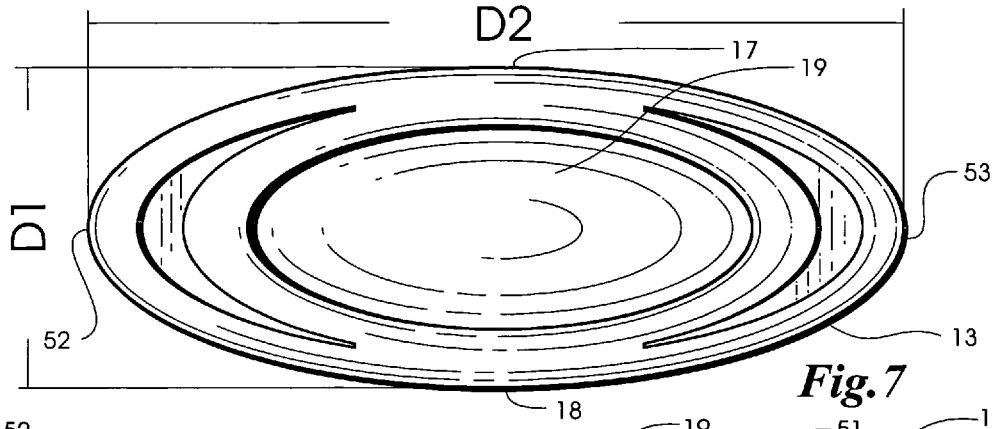
FIG. 7 is a top view of a weight adjustment member according to another embodiment of the present invention.
Figure 8:
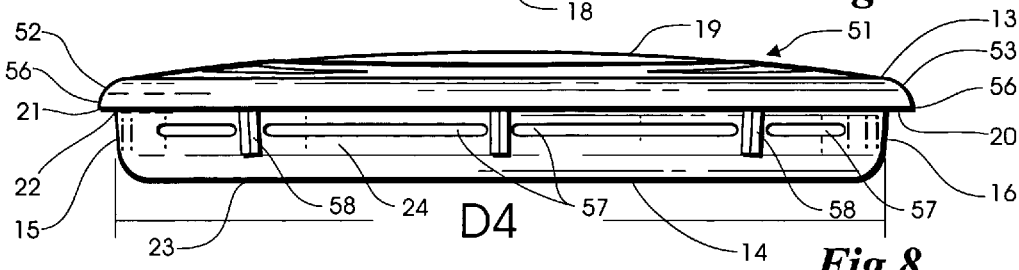
FIG. 8 is a side view of the weight adjustment member of FIG. 7.
Figure 9:
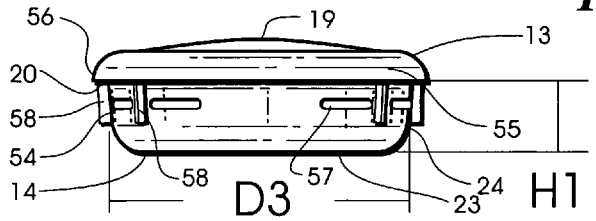
FIG. 9 is an end view of the weight adjustment member of FIG. 7.
Figure 10:
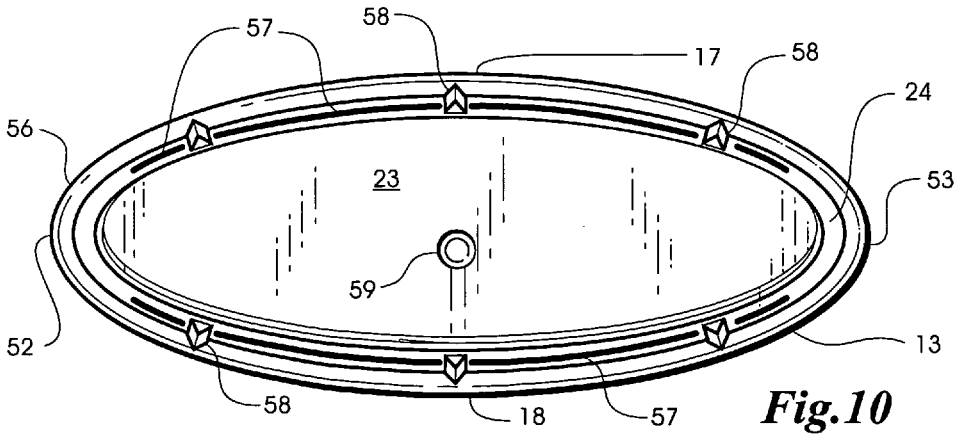
FIG. 10 is a bottom view of the weight adjustment member of FIG. 7.

Referring to FIGS. 1-4, an iron-type golf club head 31 includes a body 25 and a hosel 26 containing a cylindrical bore 27 for receiving one end of a golf club shaft (not shown). The body 25 has a heel portion 28 and a toe portion 29 that are spaced apart. The hosel 26 includes a neck 30 connected to the heel portion 28 of the body 25. The club head 31 is preferably cast from suitable metal such as stainless steel. A front face 32 arranged for impact with a golf ball (not shown) is provided on the body 25 and extends between the body heel and toe portions 28, 29 along a frontal portion of the body 25. Disposed rearwardly of the front face 32 is a back face 33.

In the iron type golf club head 31 shown in FIG. 14, a perimeter weighting element 34 protrudes rearwardly from the front face 32 and defines a primary cavity 35 in the back face 33. The primary cavity 35 is defined at its upper extremity by a top rail 36 and at its lower extremity by a sole 37. The top rail 36 extends between the body heel and toe portions 28, 29 along an upper portion of the body 25, and the sole 37 extends between the body heel and toe portions 28, 29 along a lower portion of the body 25.

The primary cavity 35 defined by the perimeter weighting element 34 has a bottom surface 38. An interior wall 39 extends from a first end 40 located adjacent the body heel portion 28 through the primary cavity 35 between the top rail 36 and the sole 37 to a second end 41 located adjacent the body toe portion 29. The interior wall 39 may be formed integrally with the bottom surface 38 of the primary cavity 35. The first and second ends 40, 41 of the interior wall 39 are preferably integrally connected to the perimeter weighting element 34 adjacent the body heel and toe portions 28, 29 thereby defining a secondary cavity or tuning port 42 within the primary cavity 35.

Referring to FIG. 1, the tuning port 42 has a first end 43 located adjacent the body heel portion 28, a second end 44 located adjacent the body toe portion 29, a bottom wall 45 and a side wall 46. The tuning port wall 46 is defined by the sole 37 of the perimeter weighting element 34 on its lower extremity 49 and by the interior wall 39 on its upper extremity 50. The tuning port wall 46 has a rim 47, an inner surface 48, and a height dimension H (FIG. 1). In some embodiments of the iron type golf club head 31, the height dimension H of the tuning port wall 46 may vary between its lower and upper extremities 49, 50. In other embodiments of the iron type golf club head 31, the height dimension H of the tuning port wall 46 may vary between its first and second ends 43, 44. In still other embodiments of the iron type golf club head 31, the height dimension H of the tuning port wall 46 may be substantially constant.

As shown in FIGS. 6-10, weight adjustment members or inserts 51 according to the present invention preferably comprise a cap 13 connected to a base 14. The cap. 13 preferably has a top surface 19, a bottom surface 20, a first side 17, a second side 18, a first end 52 and a second end 53. The bottom surface 20 of the cap 13 preferably has an outer edge 21 and an inner edge 22. The top surface 19 extends to the outer edge 21 of the bottom surface 20 defining a lip 56 between the top and bottom surfaces 19, 20 that projects outwardly and conceals at least a portion of the tuning port rim 47. The top surface 19 may be convex, concave, flat, or any other suitable shape. The bottom surface 20 of the cap 13 may be generally flat or it may be contoured.

The base 14 of the weight adjustment member 51 preferably has a first end 15, a second end 16, a first side 54, a second side 55, a bottom surface 23 and a side surface 24. The side surface 24 extends between the inner edge 22 of the cap bottom surface 20 and the base bottom surface 23. The side surface 24 may be flat or contoured. The perimeter of the base bottom surface 23 may be less than, equal to, or greater than the perimeter of the inner edge 22 of the cap bottom surface 20.

The side surface 24 of the base 14 has a height dimension H1. In the embodiment of the weight adjustment member or insert 51 shown in FIG. 6, the height dimension H1 of the side surface 24 on the first side 54 of the base 14 will be different than the height dimension H1 of the side surface 24 on the second side 55 of the base 14. In the embodiment of the weight adjustment member 51 shown in FIGS. 7-10, the height dimension H1 of the side surface 24 of the base 14 is substantially equal on the first and second sides 54, 55 of the base 14.

It will be understood that the height dimension H1 of the base side surface 24 preferably will be approximately equal to, less than, or greater than, the height dimension H of the tuning port wall 46. Any variation in the height dimension H1 of the base side surface 24 between its first and its second ends 15, 16 and/or its first and second sides 54, 55 will be proportional to a variation in the height dimension H of the tuning port wall 46. When the weight adjustment member 51 is mounted in the tuning port 42, the base 14 will be received in the tuning port 42 and the lip 56 will conceal at least a portion of the tuning port rim 47.

It will further be understood that the shape of the base 14 of the weight adjustment member 51 may be generally circular, oval, rectangular, square, or may be made in any other shape in which the tuning port 42 of the iron type golf club head 31 is made. The shape of the cap 13 of the weight adjustment member 51 may be the same as or different than the shape of the base 14 of the weight adjustment member 51. The weight adjustment member 51 may exhibit any desired weight and/or density. The weight adjustment member 51 may be formed of any suitable material, such as plastic, metal, or composite material. Integrally affixed to the cap 13 of the weight adjustment member 51 may be a cover made of the same or a different material, which cover may, for example, include letters of the alphabet and/or other symbols.

In order to secure the weight adjustment member 51 in the tuning port 42, adhesive, such as epoxy, may be applied to the base bottom surface 23, the base side surface 24, the tuning port bottom wall 45 and the inner surface 48 of the tuning port wall 46. Because the lip 56 lies on or above the tuning port rim 47 thereby concealing the tuning port rim 47, any visible or excess adhesive remains under lip 56 and does not seep beyond the outer edge 21 of the cap bottom surface 20. Furthermore, the lip 56 hides any adhesive that is between the side surface 24 of the weight adjustment member 51 and the inner surface 48 of the tuning port wall 46.

Due to the significantly increased effectiveness of the weight adjustment member 51 in preventing the escape of excess adhesive while hiding from view adhesive used to secure the weight adjustment member 51 in the tuning port 42, less time is spent inspecting for adhesive outside of the tuning port 42 or between the inner surface 48 of the tuning port wall 46 and the side surface 24 of the weight adjustment member 51 and addressing any such adhesive.

In the embodiment of the weight adjustment member 51 shown in FIGS. 7-10, a plurality of recesses or indents 57 are formed in the base side surface 24 below the lip 56 extending peripherally around the base 14. When adhesive is applied to the bottom surface 23 and/or the side surface 24 of the base 14 to secure the weight adjustment member 51 in the tuning port 42, excess adhesive will collect in these recesses or indents 57 and be prevented from being pushed out of the tuning port 42.

In the embodiment of the weight adjustment member 51 shown in FIGS. 7-10, a plurality of integral tabs 58 extend outwardly from the side surface 24 of the base 14. The tabs 58 are disposed below the lip 56 and are spaced apart from each other. Since these tabs 58 will contact the inner surface 48 of the tuning port wall 46 when the weight adjustment member 51 is mounted in the tuning port 42, the tabs 58 will properly position (i.e., "center") the weight adjustment member 51 with respect to the tuning port 42.

In the embodiment of the weight adjustment member 51 shown in FIGS. 7-10, a locating device, such as an indentation 59, is located off-center on the bottom surface 23 of the base 14 so that, when the weight adjustment member 51 is properly mounted in the tuning port 42, it will mate with a corresponding locating device such as a protrusion 60 (FIG. 1) located off-center on the bottom wall 45 of the tuning port 42. The corresponding locating devices 59, 60 on the bottom surface 23 of the base 14 of the weight adjustment member 51 and on the bottom surface 45 of the tuning port 42 operate to properly position and orient the weight adjustment member 51 with respect to the tuning port 42 when the base 14 is received in the tuning port 42. Alternatively, one or more locating devices may be positioned on the side surface 24 of the weight adjustment member 51 to mate with one or more locating devices on the inner surface 48 of the tuning port wall 46.

In the embodiment of the weight adjustment member 51 shown in FIGS. 7-10, dimension D1 measured between the first and second sides 17, 18 of the cap 13 is 0.78 inches, dimension D2 measured between the first and second ends 52, 53 of the cap 13 is 1.88 inches, dimension D3 measured between the first and second sides 54, 55 of the base 14 is 0.681 inches, dimension D4 measured between the first and second ends 15, 16 of the base 14 is 1.783 inches, and the height dimension H1 of the side surface 24 of the base 14 is 0.165 inches.

What is claimed is:

1. A weight adjustment member for a golf club head wherein the golf club head includes a tuning port with a rim, said weight adjustment member comprising:

a base adapted to be received in said tuning port, said base including a side surface, a first side and a second side, said side surface having a height dimension that is different on said first and second sides;

a cap connected to said base, said cap having a lip projecting outwardly for concealing at least a portion of said tuning port rim when said base is received in said tuning port;

a first locating device on a bottom surface of said base and a second locating device on a bottom wall of said tuning port;

said first and second locating devices mating with each other when said base is received in said tuning port; and said first locating device comprising an indentation and said second locating device comprising a protrusion.

2. The weight adjustment member of claim 1, wherein said indentation and said protrusion are located off-center with respect to said base and said tuning port, respectively.

3. The weight adjustment member of claim 1, wherein the golf club head includes a body with a front face arranged for impact with a golf ball and a back face disposed rearwardly of said front face.

4. The weight adjustment member of claim 3, wherein the golf club head includes a perimeter weighting element protruding rearwardly from said front face to define a primary cavity in said back face.

5. The weight adjustment member of claim 4, wherein said perimeter weighting element includes a top rail and a sole, and wherein said primary cavity is defined at its upper extremity by said top rail and at its lower extremity by said sole.

6. The weight adjustment member of claim 5, wherein said top rail extends between heel and toe portions of the body along an upper portion of the body and wherein said sole extends between the heel and toe portions of the body along a lower portion of the body.

7. The weight adjustment member of claim 6, wherein the golf club head includes an interior wall which extends from a first end located adjacent the heel portion of the body through said primary cavity between said top rail and said sole to a second end located adjacent the toe portion of the body to define said tuning port within said primary cavity.

8. A weight adjustment member for a golf club head wherein the golf club head includes a tuning port with a rim, said weight adjustment member comprising:

a base adapted to be received in said tuning port, said base including a side surface having a plurality of recesses formed therein;

a cap connected to said base, said cap having a lip projecting outwardly for concealing at least a portion of said tuning port rim when said base is received in said tuning port;

a first locating device on a bottom surface of said base and a second locating device on a bottom wall of said tuning port;

said first and second locating devices mating with each other when said base is received in said tuning port; and said first locating device comprising an indentation and said second locating device comprising a protrusion.

9. The weight adjustment member of claim 8, wherein the golf club head includes a body with a front face arranged for impact with a golf ball and a back face disposed rearwardly of said front face.

10. The weight adjustment member of claim 9, wherein the golf club head includes a perimeter weighting element protruding rearwardly from said front face to define a primary cavity in said back face.

11. The weight adjustment member of claim 10, wherein said perimeter weighting element includes a top rail and a sole, and wherein said primary cavity is defined at its upper extremity by said top rail and at its lower extremity by said sole.

12. The weight adjustment member of claim 11, wherein said top rail extends between heel and toe portions of the body along an upper portion of the body and wherein said sole extends between the heel and toe portions of the body along a lower portion of the body.

13. The weight adjustment member of claim 12, wherein the golf club head includes an interior wall which extends from a first end located adjacent the heel portion of the body through said primary cavity between said top rail and said sole to a second end located adjacent the toe portion of the body to define said tuning port within said primary cavity.

14. A weight adjustment member for a golf club head wherein the golf club head includes a tuning port with a rim, said weight adjustment member comprising:

a base adapted to be received in said tuning port, said base including a side surface with a plurality of tabs extending therefrom;

a cap connected to said base, said cap having a lip projecting outwardly for concealing at least a portion of said tuning port rim when said base is received in said tuning port;

a first locating device on a bottom surface of said base and a second locating device on a bottom wall of said tuning port;

said first and second locating devices mating with each other when said base is received in said tuning port; and said first locating device comprising an indentation and said second locating device comprising a protrusion.

15. The weight adjustment member of claim 14 wherein said tabs are located below said lip.

16. The weight adjustment member of claim 14, wherein the golf club head includes a body with a front face arranged for impact with a golf ball and a back face disposed rearwardly of said front face.

17. The weight adjustment member of claim 16, wherein the golf club head includes a perimeter weighting element protruding rearwardly from said front face to define a primary cavity in said back face.

18. The weight adjustment member of claim 17, wherein said perimeter weighting element includes a top rail and a sole, and wherein said primary cavity is defined at its upper extremity by said top rail and at its lower extremity by said sole.

19. The weight adjustment member of claim 18, wherein said top rail extends between heel and toe portions of the body along an upper portion of the body and wherein said sole extends between the heel and toe portions of the body along a lower portion of the body.

20. The weight adjustment member of claim 19, wherein the golf club head includes an interior wall which extends from a first end located adjacent the heel portion of the body through said primary cavity between said top rail and said sole to a second end located adjacent the toe portion of the body to define said tuning port within said primary cavity.

* * * * *